US009602915B1

(12) United States Patent
Howarth et al.

(10) Patent No.: US 9,602,915 B1
(45) Date of Patent: Mar. 21, 2017

(54) MAGNETICALLY CONTROLLABLE TRANSDUCER BACKING COMPONENT

(71) Applicants: Thomas R Howarth, Portsmouth, RI (US); Pamela Benjamin, Portsmouth, RI (US)

(72) Inventors: Thomas R Howarth, Portsmouth, RI (US); Kim C. Benjamin, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/870,146

(22) Filed: Sep. 30, 2015

Related U.S. Application Data

(63) Continuation-in-part of application No. 13/248,337, filed on Sep. 29, 2011, now Pat. No. 9,215,525.

(51) Int. Cl.
*H04R 25/00* (2006.01)
*H04R 1/28* (2006.01)
*H04R 1/22* (2006.01)

(52) U.S. Cl.
CPC ..... *H04R 1/2834* (2013.01); *H04R 1/222* (2013.01); *Y10S 977/932* (2013.01)

(58) Field of Classification Search
CPC ..... H04R 9/027; H04R 23/02; H04R 2400/01
See application file for complete search history.

(56) References Cited

U.S. PATENT DOCUMENTS

| | | | | |
|---|---|---|---|---|
| 7,386,144 | B2 * | 6/2008 | Vincent | H04R 7/20 381/404 |
| 7,403,628 | B2 * | 7/2008 | Murray | H04R 7/045 381/152 |
| 7,883,636 | B2 * | 2/2011 | Fuchs | B82Y 25/00 252/62.52 |
| 9,516,420 | B2 * | 12/2016 | Kim | B06B 1/0292 |
| 2001/0008858 | A1 * | 7/2001 | Sullivan | A63B 37/0003 473/374 |
| 2002/0193137 | A1 * | 12/2002 | Bank | H04M 1/0214 455/550.1 |
| 2010/0014696 | A1 * | 1/2010 | Boschung | G10K 11/22 381/328 |
| 2016/0021465 | A1 * | 1/2016 | Miyoshi | H04R 3/04 381/98 |

* cited by examiner

*Primary Examiner* — Curtis Kuntz
*Assistant Examiner* — Ryan Robinson
(74) *Attorney, Agent, or Firm* — James M. Kasischke; Michael P. Stanley

(57) ABSTRACT

A transducer is provided that converts energy between two forms using active components. The transducer also includes passive components in contact with the active components that perform passive component functions separate from the energy conversion function. The passive components include ferrofluids and have elastic properties that are modifiable by exposure of the passive component to a magnetic field to selectively control the energy conversion function.

1 Claim, 3 Drawing Sheets

MAGNETICALLY CONTROLLABLE TRANSDUCER BACKING COMPONENT

This application is a continuation-in-part of and claims the benefit of prior patent application; U.S. patent application Ser. No. 13/248,337 filed on Sep. 29, 2011 and entitled "Transducer with Modifiable Passive Component" by the inventors, Thomas Howarth and Kim Benjamin.

STATEMENT OF GOVERNMENT INTEREST

The invention described herein may be manufactured and used by or for the Government of the United States of America for Governmental purposes without the payment of any royalties thereon or therefore.

BACKGROUND OF INVENTION

1) Field of the Invention

The present invention is directed to a backing component for transducers.

2) Description of Prior Art

Transducers are devices that convert one form of energy into another form of energy. For example, a speaker converts electrical energy to sound or sound waves. The reverse would be the conversion of sound into electrical energy, which is known as a microphone. In addition to converting energy in a single direction, transducers can convert energy in two directions. For example, a single device can function as both a speaker and a microphone, or given transducer can be switched between operating in either a transmit mode and receive mode.

Generally, a transducer includes two types of components (active and passive components). These components can be arranged as layers in the transducer. Active layers contribute to the energy conversion of the transducer.

Passive layers compliment the active layers, but do not contribute to the energy conversion. For example, the passive layer can be a support for an active layer. Therefore, the materials and configuration of passive layers are chosen to have qualities that enhance the active layer performance. However, the desired qualities of the passive layer are different depending on whether the transducer is being used in a transmit mode or a receive mode. Consequently, current passive layers only compliment an active layer in a single mode of operation, (e.g., either a transmit mode or a receive mode).

A transducer is therefore desired that includes passive components or passive layers that complement the active components of active layers of the transducer and therefore enhance the overall performance of the transducer in two modes of operation (e.g., the transmit mode to receive mode).

SUMMARY OF THE INVENTION

Exemplary embodiments of transducers in accordance with the present invention contain passive components constructed from materials that can be selectively configured to compliment the active components of the transducer in two directions of energy conversion.

In one embodiment, the materials of the passive components change their elastic properties when exposed to an applied magnetic field. These materials include magnetorheological materials and magnetoviscoelastic materials, which respectively display a large variation in viscosity and elastic modulus when exposed to a magnetic field.

In another embodiment, the material of the passive material is ferrofluids. The difference between ferrofluids and MR fluids is the size of the particles. The particles in a ferrofluid primarily consist of nanoparticles which are suspended by Brownian motion and generally will not settle under normal conditions. Brownian motion is the random drifting of particles suspended in a fluid (a liquid or a gas) or the mathematical model used to describe such random movements (often called a particle theory).

In accordance with one exemplary embodiment, the present invention is directed to a transducer having an energy conversion function that includes a transmit mode and a receive mode. The transducer includes a passive component having a function that is separate from the energy conversion function of the transducer and an elastic property modifiable by exposure to a magnetic field to selectively compliment the energy conversion function in the transmit mode or the receive mode. Exposure of the passive component to the magnetic field yields a notable change in the elastic property. This elastic property includes elastic modulus and viscosity.

In one embodiment, the passive component is a solid polymer having a plurality of ferrous particles distributed in the solid polymer. In another embodiment, this solid polymer is a magnetoviscoelastic polymer. The ferrous particles have a first organized alignment in the solid polymer and a second disorganized alignment in the solid polymer upon exposure to the magnetic field. The particles of the ferrofluids are in nanoscale (a diameter of ten nanometers or less); thereby, allowing the particles stay suspended in solution longer than existing arrangements.

In yet another embodiment, the passive component is a liquid polymer having a plurality of ferrous particles distributed in the liquid polymer. In one embodiment, this liquid polymer is a magnetorheological polymer. The ferrous particles in the liquid polymer have a first disorganized alignment and a second organized alignment upon exposure to the magnetic field. Suitable ferrous particles for use in the solid or liquid polymer include iron, iron oxide, iron cobalt, iron nickel, iron silicon and iron nitride.

In another exemplary embodiment, the present invention is directed to a transducer having an active component with an active component function that is at least a portion of an energy conversion function of the transducer. The transducer also includes a passive component in communication with the active component.

This passive component has a function that is separate from the energy conversion function of the transducer. The passive component function affects the active component function thru magnetism based on volume, material and temperature. In addition, the passive component has an elastic property that is modifiable by exposure to a magnetic field. In one embodiment, exposure of the passive component to the magnetic field yields up to approximately a forty change percent in the elastic property. This elastic property is an elastic modulus or viscosity.

The passive component can include a solid magnetorheological fluid polymer or a magnetoviscoelastic solid polymer. In addition, the passive component includes a plurality of ferrous particles. These ferrous particles include iron, iron oxide, iron cobalt, iron nickel, iron silicon and iron nitride.

In yet another embodiment, the ferrous particles in the passive layer have a disorganized alignment and an organized alignment. The ferrous particles switch between the disorganized alignment and the organized alignment upon exposure to the magnetic field; thereby, modifying the elastic property of the passive layer. A ferro-fluid can perform this action.

The transducer can include a plurality of active components arranged as a plurality of active component layers and a plurality of passive components arranged as a plurality of passive component layers. Each passive component layer is in communication with at least one of the active component layers to affect the active component function.

Exemplary embodiments of the present invention are also directed to a method for using a transducer for energy conversion. In the method, an active component of the transducer transfers energy between a first form or energy and a second form of energy. A passive component of the transducer that is in communication with the active component is used to compliment the function of the active component when transferring the energy between the first form of energy and the second form of energy. A magnetic field is applied to the passive component to change an elastic property of the passive component. The effect of the passive component on the transfer of energy by the active component between the first form of energy and the second form of energy is dependent upon the elastic property of the passive component.

DETAILED DESCRIPTION OF THE INVENTION

Exemplary embodiments of systems and methods in accordance with the present invention provide for the transfer or conversion of energy between a first form of energy and a second form of energy using a transducer having an energy conversion function. This transfer of energy includes a transfer from the first form of energy to the second form of energy and from the second from of energy to the first form of energy. The direction of transfer is reversible and selectable by the user of the transducer.

Suitable energy conversion functions include, but are not limited to, thermal energy, chemical energy, electrical energy, radiant energy, nuclear energy, magnetic energy, elastic energy, sound energy, mechanical energy and luminous energy. In one embodiment, the first form of energy is sound or sound waves and the second form of energy is electrical energy. The transducer has an energy conversion function with a transmit mode that converts the electrical energy to sound, transmitting the sound; thereby, to waves through the air. The transducer also has a receive mode that receives sound waves from the air and converts the sound to electrical energy.

Suitable types of transducers include, but are not limited to, electromagnetic transducers such as antennae, cathode ray tubes, fluorescent lamps, light bulbs, magnetic cartridges, photo detectors, photo resistors, tape heads and Hall effect sensors, electrochemical transducers such as pH probes, electro-galvanic fuel cells and hydrogen sensors, electromechanical transducers such as electro active polymers, galvanometers, microelectromechanical systems, rotary motors, linear motors, vibration powered generators, potentiometers, load cells, accelerometers, strain gauges, string potentiometers, air flow sensors and tactile sensors, electro acoustic transducers such as loudspeakers, earphones, microphones, tactile transducers, piezoelectric crystals, geophones, gramophone pickups, hydrophones and sonar transponders, photoelectric transducers such as laser diodes, light-emitting diodes, photodiodes, photo resistors, phototransistors and photomultiplier tubes, electrostatic transducers, thermoelectric transducers such as resistance temperature detectors, thermocouples, Peltier coolers and thermistors and radioacoustic transducers such as Geiger-Müller tubes and radio receivers.

Figure 1:
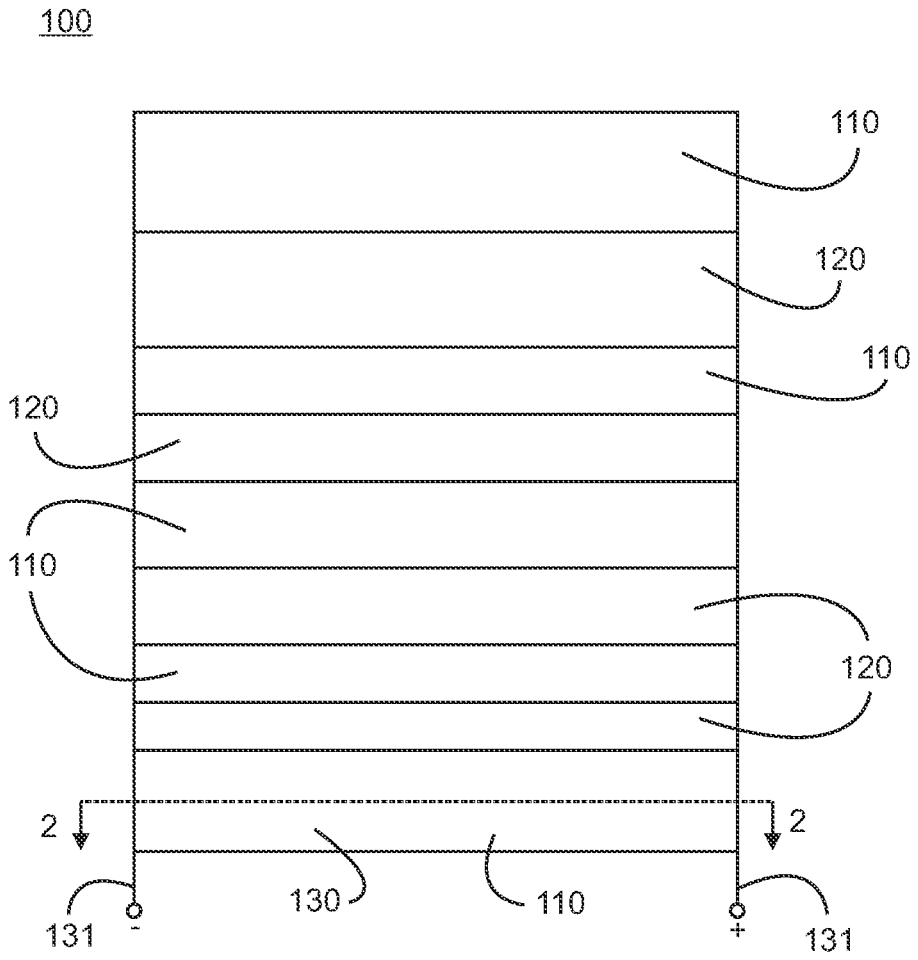
FIG. 1 is an illustration of a transducer in accordance with the present invention.

Referring to FIG. 1, an exemplary embodiment of a transducer 100 in accordance with the present invention is illustrated. In the figure, the transducer 100 includes at least one and preferably a plurality of active components 110. The active components 110 each contribute to an active component function or energy conversion functionality of the transducer 100. Suitable active components include, but are not limited to, transistors, diodes, piezoelectric materials, generators, photovoltaic cells and thermocouples.

The transducer 100 also includes at least one and preferably a plurality of passive components 120 positioned within the transducer. Each passive component 120 is in communication with at least one of the active components 110. This communication includes, but is not limited to, physical contact, electrical contact and fluid communication. As illustrated, the active components 110 and passive components 120 are positioned as alternating active layers and passive layers. However, the transducers 100 in accordance with the present invention are not limited to arrangements of layers of active components and passive components. In addition, the layers do not all have to alternate, and two active layers or two passive layers can be adjacent layers in the transducer 100.

Each passive component 120 is separate from and is not involved in the energy conversion functionality of the transducer 100. Instead, each passive component 120 contributes a passive component function to the transducer 100. These passive component functions including spacing, insulation, filtering, polarizing, focusing, supporting, heating, cooling, dampening and weighting, among others. Therefore, the passive component function of a given passive component 120 is selected to affect and to compliment the active component function of the active component 110 to enhance the overall energy transfer functionality of the transducer 100. Suitable passive components include, but are not limited to lenses, strain gauges, inductors, conductors, insulators, resistors and transformers. The ability of the passive components 120 to compliment the active functions of the active components 110 depends upon the mode of operation of the transducer 100 (i.e., the direction of energy transfer, and the physical properties of the passive components).

For example, a more flexible passive component is preferable for one mode of operation, and a more rigid passive component is preferable for the opposite mode of operation. Therefore, the passive components 120 of the present invention are configured to change their physical properties selectively, controllable and reversibly. These physical properties are changed depending on the mode of operation or direction of energy transfer of the transducer 100.

Suitable physical properties of the passive components 120 that can be modified are the elastic properties of the passive component. These elastic properties include, but are not limited to, yield strength, stress, strain, elastic modulus and viscosity. Preferably, the elastic property to be modified is elastic modulus or viscosity.

The transducer 100 includes an activating mechanism, based on material and volume fraction, to selectively control or to selectively modify the elastic properties of the passive components 120. In addition, the passive components 120 are constructed from materials that respond to the mechanism used to control the elastic properties of the passive component.

The passive components 120 can be constructed from materials having elastic properties that are modifiable by exposure to a magnetic field. Alternatively, a magnetic field can be applied to the passive components 120 to modify the elastic properties of the passive components to selectively compliment the energy conversion function of the transducer 100 in either the transmit mode or the receive mode.

In another embodiment, the material of the passive material is ferrofluids. The difference between ferrofluids and MR fluids is the size of the particles. The particles in a ferrofluid primarily consist of nanoparticles which are suspended by Brownian motion and generally will not settle under normal conditions. Brownian motion is the random drifting of particles suspended in a fluid (a liquid or a gas) or the mathematical model used to describe such random movements (often called a particle theory).

Figure 2:
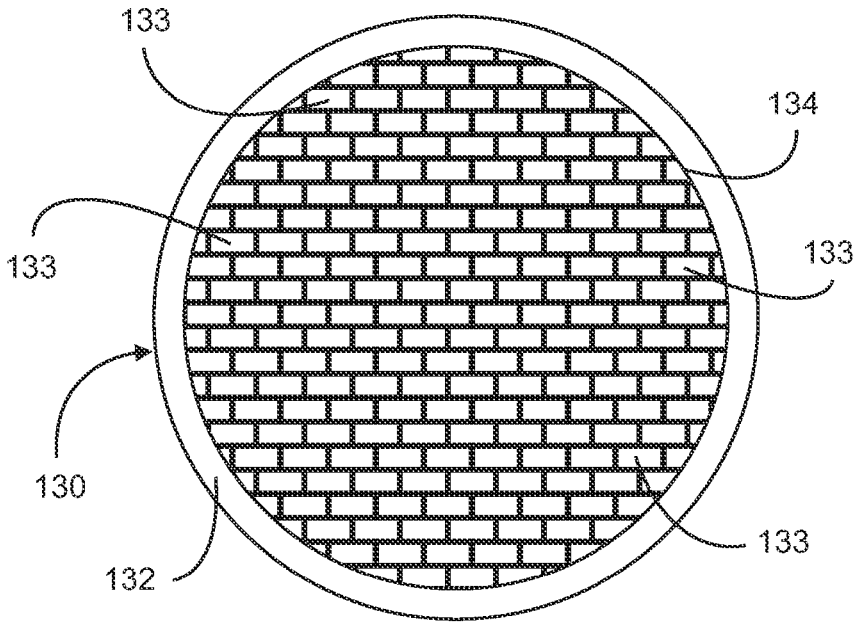
FIG. 2 of the transducer of the present invention with the view through reference line 2-2 of FIG. 1.
Figure 3:
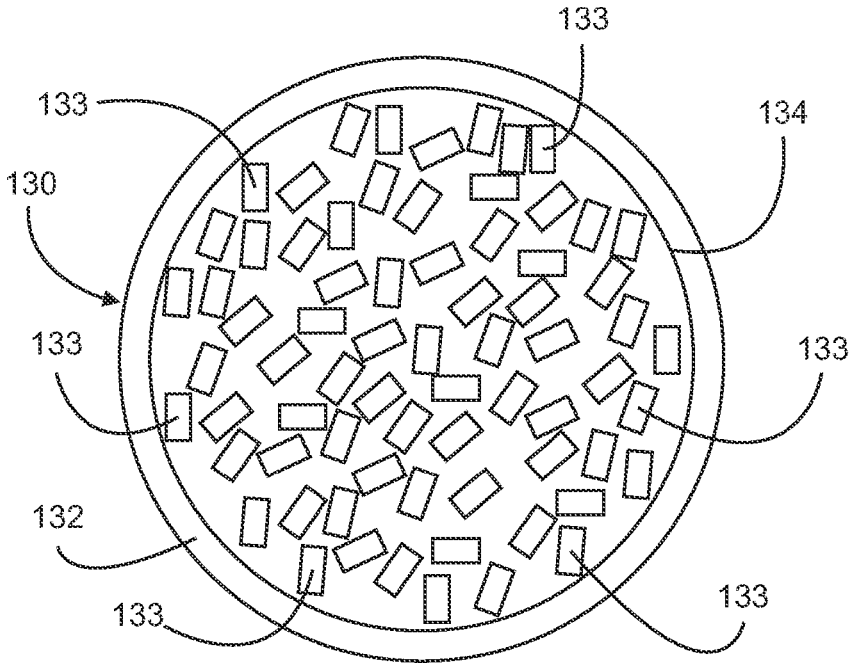
FIG. 3 is the view of FIG. 2 with the passive layer having a modified elastic property.

As illustrated, a given passive layer is configured as a support layer 130 in contact with an active layer in the transducer. The elastic properties of the passive support layer 130 will affect the flexibility of the active layer to which it is in contact. As shown in FIGS. 2 and 3, the passive support layer 130 is surrounded by a coil of wire 132 that is used to generate a magnetic field that is imparted to the central material 134 that is changeable to an elastic property. Suitable materials for the coil of wire include copper and aluminum. A pair of electric contacts 131 (FIG. 1) are used in contact with the coil of wire in order to supply the required current to generate the magnetic field. Although illustrated as a coil of wire incorporated into the transducers or into the passive layer; the magnetic field can be generated from any suitable-source including sources external to the transducer.

Suitable materials that change their elastic property upon exposure to a magnetic field include, but are not limited to, magnetorheological polymers and magnetoviscoelastic polymers. These materials include a plurality of ferrous particles 133. These ferrous materials are sensitive to the applied magnetic field. Suitable ferrous particles include, but are not limited to, iron, iron oxide, iron cobalt, iron nickel, iron silicon and iron nitride.

Although illustrated as rectangular particles, the particles are not limited to rectangular particles but can be particles having any suitable shape to include spherical particles as well randomly shaped particles and particles having other geometric shapes. Preferably, the material for the passive layer changes its elastic property by up to approximately forty percent when exposed to the magnetic field; the range being dependent on volume and magnetic field.

Selective application of the magnetic field to the material of the passive layer, for example by turning on and off the current through the coil of wire 132, causes the ferrous particles 133 to move between an organized state as illustrated in FIG. 2 and a disorganized state as illustrated in FIG. 3. Changing the relative organization of the ferrous particles 133 changes an elastic property of the material.

The passive component material can be a magnetorheological liquid polymer containing ferrous particles that are initially in a disorganized state is shown in FIG. 3. The applied magnetic field causes the particles to align as in FIG. 2, changing the viscosity of the magnetorheological liquid polymer containing passive layer.

Figure 4:
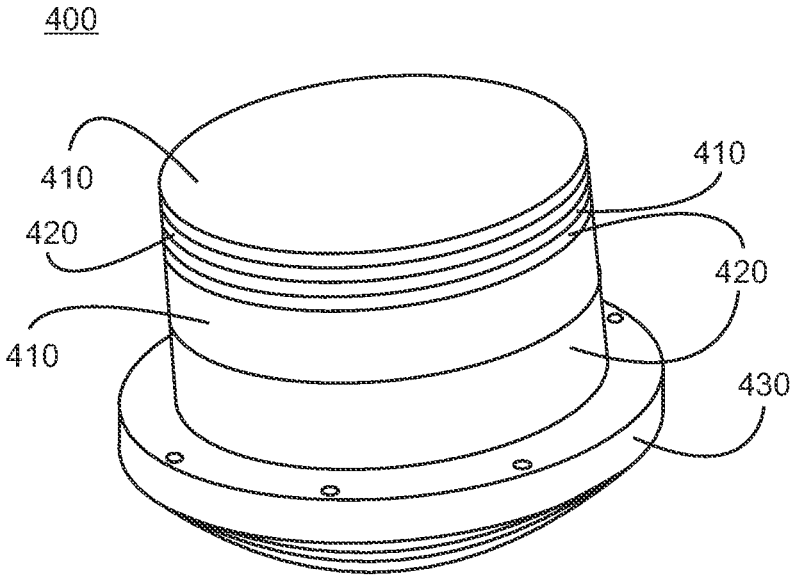
FIG. 4 is a perspective view of another embodiment of a transducer in accordance with the present invention.
Figure 5:
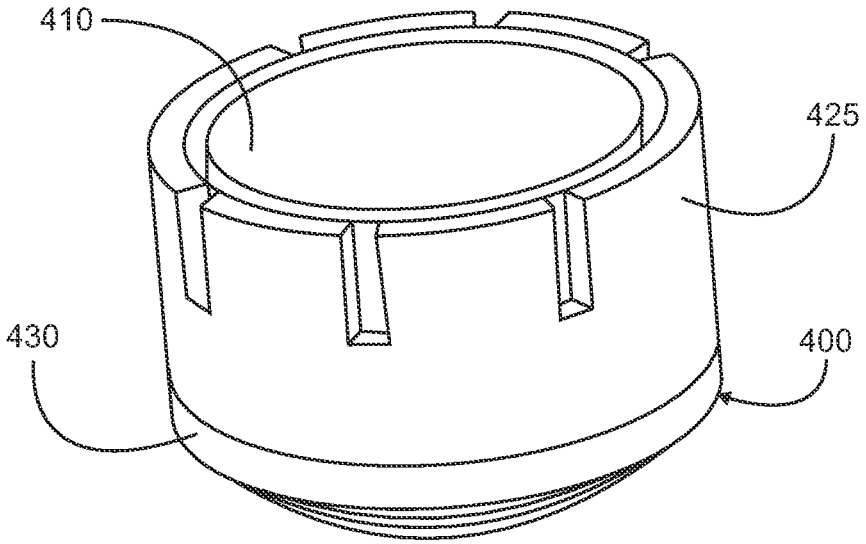
FIG. 5 is a perspective view of the transducer of FIG. 4 with a housing.

Referring to FIG. 4, an exemplary embodiment of a transducer 400 in accordance with the present invention is illustrated. The transducer 400 includes a plurality of alternating active layers 410 and passive layers 420. The active layers and passive layers are configured and constructed of materials as discussed herein. The active and passive layers are adhesively bonded together. As shown in FIG. 5, the adhesively bonded layers are encapsulated in a mountable housing 425. Electrical connections (not shown) to the active layers are passed from the encapsulated region to the other side of a water proof bulkhead 430 (See FIG. 4).

As described above, a coil of wire associated with one or more of the passive layers induce a magnetic field in the associated passive layers. When the passive layer is a magnetoviscoelastic solid polymer, the ferrous particles in its quiescent state remain in their organized alignment, yielding one extreme of the elastic modulus of the passive layer. When the coil of wire is energized and the magnetic field is present, the organized of columnar nature of the ferrous particles is destroyed, yielding a disorganized ferrous particle structure and an opposite extreme for the elastic modulus.

Therefore, the passive layer is moved between these organized and disorganized states to present the appropriate backing stiffness to an active layer in either one of two directions of energy transfer (e.g., transmit or receive). Switching the magnetic field on-and-off or switching the particle alignment between organized and disorganized can be step wise or time varying depending on the desired stiffness versus time function.

Exemplary embodiments in accordance with the present invention are also directed to a method for converting energy. In accordance with this method, an active component function is performed using an active component of a transducer. The active component function is at least a portion of an energy conversion function of the transducer. Passive components of the transducer are used to perform a passive component function that is separate from the energy conversion function of the transducer. However, this passive component function affects the active component function; thereby, enhancing the overall function of the transducer. In order to benefit the active component function of the active components in two directions of energy transfer; the elastic properties of the passive components are modified—preferably by exposing the passive components to a magnetic field.

It will be understood that many additional changes in details, materials, steps, and arrangements of parts which have been described herein and illustrated in order to explain the nature of the invention, may be made by those skilled in the art within the principle and scope of the invention as expressed in the appended claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A transducer for use in an underwater environment, said transducer comprising:

a plurality of active components with each of said active components having an energy conversion function for a transmit mode and a receive mode;

a plurality of passive components with each of said passive components in adhesive contact, electrical contact and fluid communication with each of said active components and with each of said passive components comprising an amount of ferrofluid, said passive components having a passive component function separate from said energy conversion function of said active components;

a plurality of coils of wire, with each of said coils of wire encompassing each of said passive components; and a mountable housing encapsulating said active components, said passive components and said coils;

wherein each of said active components is positioned as an alternating layer to each of said passive components;

wherein an elastic property of each of said passive components is modifiable by exposure to a magnetic field generated by each of said coils of wire to select a backing stiffness that enables the energy conversion function of each of said active components in the transmit mode and the receive mode and wherein the elastic property of each of said passive components includes yield strength, stress, strain, elastic modulus and viscosity;

wherein nanoparticles of said amount of ferrofluid consists of iron, iron oxide, iron cobalt, iron nickel, iron silicon and iron nitride.

* * * * *